US006183298B1

(12) United States Patent
Henningsen

(10) Patent No.: US 6,183,298 B1
(45) Date of Patent: Feb. 6, 2001

(54) CONNECTOR FOR COAXIAL CABLE WITH FRICTION LOCKING ARRANGEMENT

(75) Inventor: Jimmy Ciesla Henningsen, Næstved (DK)

(73) Assignee: Gilbert Engineering Co., Inc., Glendale, AZ (US)

( * ) Notice: Under 35 U.S.C. 154(b), the term of this patent shall be extended for 0 days.

(21) Appl. No.: 09/417,488

(22) Filed: Oct. 13, 1999

(30) Foreign Application Priority Data

Oct. 13, 1998 (EP) ..... 98119251

(51) Int. Cl.[7] ..... H01R 9/05
(52) U.S. Cl. ..... 439/578; 439/582
(58) Field of Search ..... 439/578, 582, 439/583, 584

(56) References Cited

U.S. PATENT DOCUMENTS

| | | | | |
|---|---|---|---|---|
| 3,977,752 | | 8/1976 | Freitag . | |
| 5,352,134 | * | 10/1994 | Jacobsen et al. | 439/584 |
| 5,360,239 | * | 11/1994 | Klementich | 285/94 |
| 5,542,861 | * | 8/1996 | Anhalt et al. | 439/578 |
| 5,620,339 | * | 4/1997 | Gray et al. | 439/578 |
| 5,651,698 | | 7/1997 | Locati et al. . | |

FOREIGN PATENT DOCUMENTS 33828953 3/1990 (DE) .
1416133 12/1995 (GB) .

* cited by examiner

*Primary Examiner*—Lincoln Donovan
*Assistant Examiner*—Kyung S. Lee
(74) *Attorney, Agent, or Firm*—Cahill, Sutton & Thomas P.L.C.

(57) ABSTRACT

Cable connector for coaxial cable, comprising a bushing (2) for providing an axial displacement of parts (4, 5, 6, 7, 8) in the connector, whereby these parts are brought into mechanical and/or electrical engagement with the coaxial cable. The axial displacement is provided by screwing a thread (10) provided on the bushing (2) onto a corresponding thread (9) provided in the main body (1) of the connector. The axial displaceable parts in the connector comprising a ferrule (4) for engaging the outer conductor or screen of the coaxial cable, said ferrule (4) comprising a locking arrangement for preventing rotation of the ferrule and cable. The ferrule (4) comprises a conical surface (11) and the main body (1) of the connector comprises a corresponding conical surface (12), said surfaces (11,12) being brought into locking engagement when axially displaced by the bushing (2), whereby the ferrule (4) and cable are prevented from rotating in the connector. By this construction an improved locking arrangement is provided. By further inserting a friction reducing disc (7) between the bushing (2) and the inner bushing (6) the forces acting on the locking arrangement are reduced.

6 Claims, 1 Drawing Sheet

CONNECTOR FOR COAXIAL CABLE WITH FRICTION LOCKING ARRANGEMENT

BACKGROUND OF THE INVENTION

1. Field of the Invention

The present invention relates generally to connectors for terminating the ends of coaxial cables, and more specifically, to a coaxial cable connector of the general type that grips the center conductor and the outer sheath of the coaxial cable as the connector is assembled onto the end of the coaxial cable.

2. Description of the Related Art

In cable connectors of this kind it is known to use axially displaceable components with conical formations cooperating to provide the radial compression of connecting parts to provide the electrical and mechanical connections between the connector and the coaxial cable. The axial displacement of parts in the connector is effected by a bushing provided with a thread which is screwed onto a corresponding thread provided in the main body of the connector. In such cable connectors it is known to provide a non-rotational locking arrangement between the main body of the connector and a ferrule for engaging the outer conductor or screen of the coaxial cable and/or the outer insulating jacket of the coaxial cable.

SUMMARY OF THE INVENTION

It is the object of the present invention, to provide a cable connector of the above kind, with an improved locking arrangement. This object is achieved by causing an end of the ferrule to contact, and become non-rotatably engaged with, and end of the main body to form a locking engagement therebetween as the collar is threaded onto the main body. With this arrangement the ferrule is prevented from rotating by simple engagement between conical surfaces on the ferrule and the main body of the connector. A further advantage with this construction is that the electrical contact between the ferrule and the main body of the connector is achieved circumferentially continuous along the conical engagement surfaces, whereby the shielding effectiveness is improved and the intermodulation distortion, return loss and insertion loss are reduced compared to similar connectors of traditional construction.

Preferably, one end of the main body includes a first conical surface, and one end of the ferrule includes a second conical surface; the first and second conical surfaces are brought into locking engagement as the collar is threadedly engaged with the main body. An inner bushing is preferably rotatably disposed within the second end of the collar between the second end of the collar and the second end of the ferrule; this inner bushing engages an end of the ferrule opposite the main body, and advances the ferrule into engagement with the main body as the collar is threadedly engaged with the main body. A friction reducing disc is advantageously disposed between the collar and the inner bushing for allowing the inner bushing to rotate freely relative to the collar. A first O-ring is disposed between the main body and the first end of the collar, and a second O-ring is disposed between the second end of the collar and the coaxial cable for providing a moisture-tight connector. The internal threads of the collar and the external threads of the main body are preferably provided as multiple-start threads, whereby the assembly time for as a connector with a coaxial cable will be substantially reduced, the final mounting position being reached with only a few rotations of the bushing and the threading is almost instantanously brought into engagement whereas the single thread of the prior art, having only one start, may have to be rotated up to approximately 360° before it is brought into initial engagement.

BRIEF DESCRIPTION OF THE DRAWING

In the following detailed portion of the present description, the present invention will be explained in more detail with reference to the exemplary embodiment of the cable connector for coaxial cable according to the invention shown in the drawing, in which.

DETAILED DESCRIPTION OF THE PREFERRED EMBODIMENT

Figure 1:
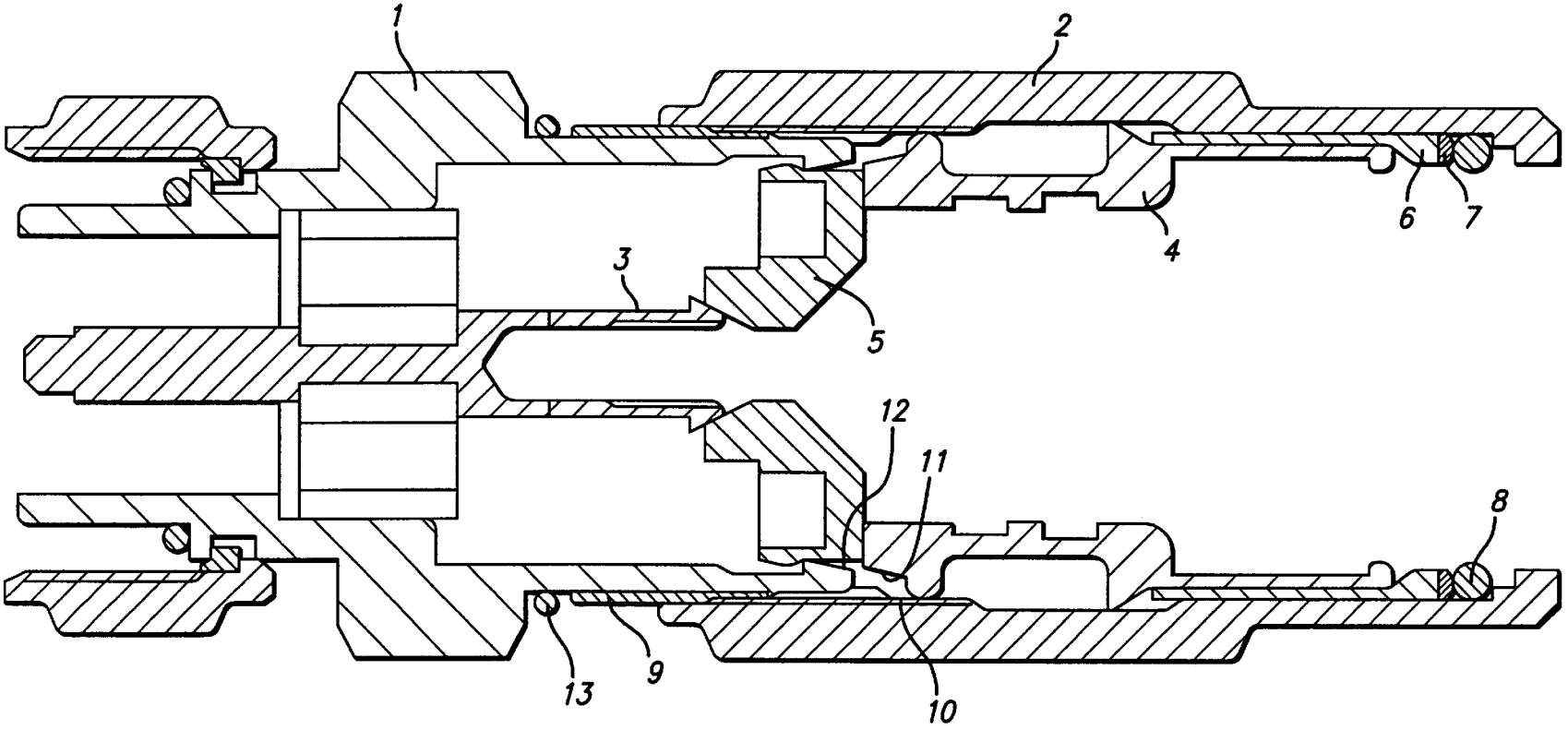
FIG. 1 shows an axial cut through a cable connector for coaxial cable in accordance with the invention.

The cable connector for coaxial cable shown in the figure comprises a main body 1, which, as shown to the left in the drawing, is provided with a plug part in the form of a BNC, TNC or the like. This plug part is not part of the invention and any suitable connection may be provided in this place. The main body 1 is provided with threads 9 for engagement with corresponding threads 10 on a bushing or collar 2. Centrally placed in the main body 1 is an axially slotted tube 3 for connection of the central conductor of the coaxial cable. The axially slotted tube 3 will be radially compressed by an axially displaceable insulating part 5 which is provided with a conical formation for engaging the axially slotted tube 3. An axially slotted ferrule 4 for electrical connection to the outer conductor of the coaxial cable and possibly for mechanical connection to the outer insulating jacket of the cable is placed behind the axially displaceable part 5 and the axial displacement of the ferrule 4 and the axially displaceable part 5 is provided by screwing the bushing 2 onto the main body 1 whereby the bushing moves an axially displaceable inner bushing 6 acting upon the ferrule 4. In the embodiment shown a friction reducing disc 7 and a O-ring 8 is placed between a step on the bushing 2 and the inner bushing 6. A further O-ring 13 is provided on the main body 1 for providing a sealing between the bushing 2 and main body 1 when the bushing 2 is brought into its final position.

The cable connector shown in the drawing functions in the following way:

A prepared coaxial cable is inserted into the connector, the cable being prepared in such a way, that the inner conductor can be inserted into the axially slotted tube 3 and the outer conductor and outer isolating jacket can be positioned inside the ferrule 4. The bushing 2 is screwed onto the main body 1 using the threads 9 and 10, whereby the bushing moves the friction reducing disc 7, the axially displaceable inner bushing 6, the axially slotted ferrule 4 and the axially displaceable part 5 whereby the axially slotted tube 3 is compressed radially into contact with the central conductor of the coaxial cable. The ferrule 4 is provided with a conical locking surface 11 which is brought into engagement with a corresponding conical locking surface 12 provided on the main body 1. The engagement between the two conical locking surfaces 11,12 prevents the ferrule 4 from rotating relative to the main body 1. The axial movement of the bushing 2 will provide an axial movement of the inner bushing 6, whereby the axially slotted ferrule 4 will be radially compressed due to appropriate conical formations on the ferrule 4 cooperating with the inner bushing 6, whereby the ferrule 4 is brought into engagement with the outer conductor and the outer isolating jacket on the coaxial cable. In the embodiment shown part of the radial compression of the ferrule 4 is provided by engagement between the front of the inner bushing 6 and a conical formation of the ferrule and other part of the radial compression of the ferrule is provided by engagement between a conical formation on the inner bushing 6 and the back part of the ferrule 4. A friction reducing disc 7 is positioned between the inner bushing 6 and the O-ring 8 and bushing 2, in order to reduce the torque forces transferred from the bushing 2 to the ferrule 4 and its conical locking surface 11, whereby the forces during assembly of the connector on the locking function of the conical locking surfaces 11, 12 are reduced.

Above the present invention has been described in connection with a specific embodiment of the invention, however it will be clear for a man skilled in the art, that many alterations can be made without departing from the following claims.

What is claimed is:

1. A coaxial cable connector for terminating the end of a coaxial cable, the coaxial cable having a center conductor and an outer conductor, the coaxial cable also including an outer insulating jacket, the coaxial cable connector comprising in combination:

a. a main body having first and second opposing ends, the first end having a conductive pin extending therefrom, and the second end having external threads formed thereon;

b. a slotted tube in electrical communication with the conductive pin and supported within said main body for receiving a bared center conductor of a coaxial cable;

c. an axially displaceable insulating member disposed within the main body for selectively compressing the slotted tube;

d. a collar having first and second ends, the first end of the collar having internal threads formed therein for mating with the external threads on the second end of the main body;

e. a ferrule rotatably disposed within the collar, the ferrule having first and second opposing ends and having a central bore for receiving the outer conductor and outer isolating jacket of the coaxial cable, the first end of the ferrule extending into the second end of the main body as the collar is threaded onto the main body, and the first end of the ferrule non-rotatably engaging the second end of the main body in locking engagement as the collar is threaded onto the main body, whereby the ferrule and the coaxial cable are prevented from rotating relative to the main body.

2. The coaxial cable connector recited by claim 1 wherein the second end of the main body includes a first conical surface and the first end of the ferrule includes a second conical surface, and wherein the first and second conical surfaces are brought into locking engagement as the collar is threadedly engaged with the main body.

3. The coaxial cable connector recited by claim 1 further comprising an inner bushing rotatably disposed within the second end of the collar between the second end of the collar and the second end of the ferrule, the inner bushing engaging the second end of the ferrule, and advancing the ferrule into engagement with the main body as the collar is threadedly engaged with the main body.

4. The coaxial cable connector recited by claim 3 further comprising a friction reducing disc disposed between the collar and the inner bushing for allowing the inner bushing to rotate freely relative to the collar.

5. The coaxial cable connector recited by claim 1 and further comprising a first O-ring disposed between the main body and the first end of the collar, and a second O-ring disposed between the second end of the collar and the coaxial cable for providing a moisture-tight connector.

6. The coaxial cable connector recited by claim 1 wherein the external threads of the main body and the internal threads of the collar are each provided as multiple-start threads.

* * * * *